United States Patent [19]

Hoffman

[11] Patent Number: 4,909,501

[45] Date of Patent: Mar. 20, 1990

[54] ANAMORPHIC AMUSEMENT DEVICE

[76] Inventor: Myrna S. Hoffman, 134 Montclair Ave., Montclair, N.J. 07042

[21] Appl. No.: 345,690

[22] Filed: May 1, 1989

[51] Int. Cl.[4] ..... G09F 1/00

[52] U.S. Cl. ..... 272/8 M; 272/8 N; 272/27 N; 40/124.1; 350/631

[58] Field of Search ..... 40/124.1; 272/27 N, 272/27 R, 8 N, 8 M, 8 R; 350/181, 293

[56] References Cited

U.S. PATENT DOCUMENTS

| | | | |
|---|---|---|---|
| 2,381,801 | 8/1945 | Bloxom | 272/8 M |
| 3,234,676 | 2/1966 | Colicki et al. | 40/124.1 |
| 3,759,607 | 9/1973 | Boyle | 272/8 M X |
| 3,834,051 | 9/1974 | Barnes Jr. et al. | 40/124.1 |

*Primary Examiner*—Richard E. Chilcot, Jr.
*Attorney, Agent, or Firm*—Charles E. Temko

[57] ABSTRACT

An anamorphic amusement device suitable for distribution and use as disposable service in fast food establishments and as disposable party goods for private consumption. The device consists of a frustoconical reflective element having means for securing the same about the frustoconical surface of a drinking cup, and a planar placemat having a distorted image printed on an upper surface. The placemat includes a printed index area for locating the cup so as to enable viewing the image in corrected form on the reflective element.

4 Claims, 1 Drawing Sheet

ANAMORPHIC AMUSEMENT DEVICE

BACKGROUND OF THE INVENTION

This invention relates generally to the field of amusement devices,and more particularly to an anamorphic type particularly adapted for use in conjunction with the serving of food in fast food establishments and the like and privately on celebratory occasions.

The difficulty in entertaining children of relatively tender years at a table for any substantial period of time while waiting to be served, and even after service is well-recognized. The probelm essentially stems from the lack of means for occupying their attention during such period, as as a result, there is usually a desire to leave the table during a mean and wander about the establishment in search of excitement. When one adult is supervising several such children, the task can become quite burdensome. Many parents of such children attempt to bring with them some small manipulative toy, but often the use of the toy increases the chance of spills and mishaps. Even where this is not the case, the attention span of young children is quite limited, so that having a single toy at the table is not always sufficient.

SUMMARY OF THE INVENTION

Briefly stated, the invention contemplates the provision of a single disposable and inexpensive toy which may be distributed at the moment of bringing an item of food to the table, and which may be readily assembled by an adult and more importantly, will remain stationary and in full view on the table during the course of eating the entire meal so as to be capable of continuous observation by the user. To this end, the disclosed device comprises a first reflective element formed of reflectively coated paper or synthetic resin as a material having means for maintaining the same in frustoconical configuration, so as to be engageable upon the outer surface of a correspondingly shaped drinking cup. The first element cooperates with a second element in the form of a placement having an upper surface which carries an anamorphic representation of a readily recognized image, and index means for locating the drinking cup thereon at precise location whereby the anamorphic representation may be viewed in undistorted condition. Since both elements are very inexpensive to manufacture, they may be discarded after a single use.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
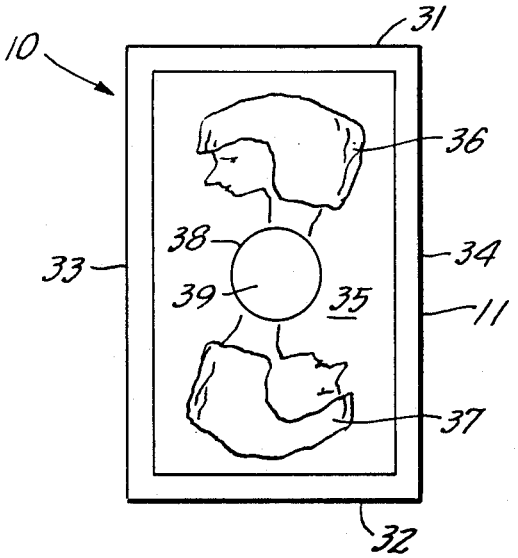
FIG. 1 is a developed view of a first element forming a part of the disclosed embodiment.
Figure 2:
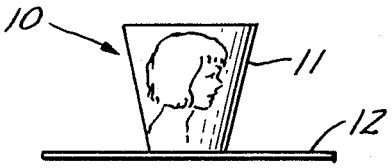
FIG. 2 is a top plan view of a second element forming a part of the embodiment.
Figure 3:
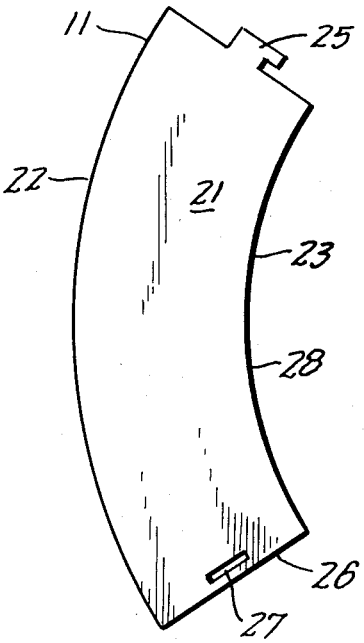
FIG. 3 is a side-elevational view showing the embodiment in fully assembled condition and ready for use.

In accordance with the invention, the device, generally indicated by reference character 10, comprises broadly: a first reflective element 11, and a second planar element 12. The first element 11 is adapted to be positioned upon the outer surface of an inverted frustrum (frustoconical vessel) such as, but not limited to, a drinking cup, while the second element is adapted to be used as a placement upon the upper surface of a table (not shown).

The first element 11 may be formed by vacuum deposition of metallic substance upon thin planar synthetic resinous material such as polyester film, or in the alternative, of metallic foil laminated paper. Thus formed, it includes an outer surface 21, and is bounded by a curved upper surface 22, a curved lower surface 23, a first end edge 26 bordering an elongated slot 27 selectively engageable with the table 25. If desired, the tab and slot may be substituted by coating a lower surface 28 with a pressure-senstive adhesive (not shown) so that it is adapted to engage the outer surface 21 when the element 11 is assembled to hollow frustoconical configuration.

The second element 12 is preferably formed from moisture-resistant paper, and although illustrated as being rectangular in form, it may take any desired shaped periphery. As illustrated, it is bounded by a pair of end edges 31 and 32, and side edges 33 and 34. A printed upper surface 35 is provided with one or more anamorphic images 36 and 37 and a printed circle 38 defining a location 39 upon which a beverage cup is placed.

Normally, the first and second elements 11 and 12 may be packaged for distribution together, and at arriving at a table with items of food, the user may position the second element 12, and assemble the first element to frustoconical condition, following which it is slipped over the exposed outer surface of a cup of corresponding size. The cup is then positioned on the area 39, at which point the anamorphic images may be viewed on the reflective outer surface 21 in undistorted condition.

Figure 4:
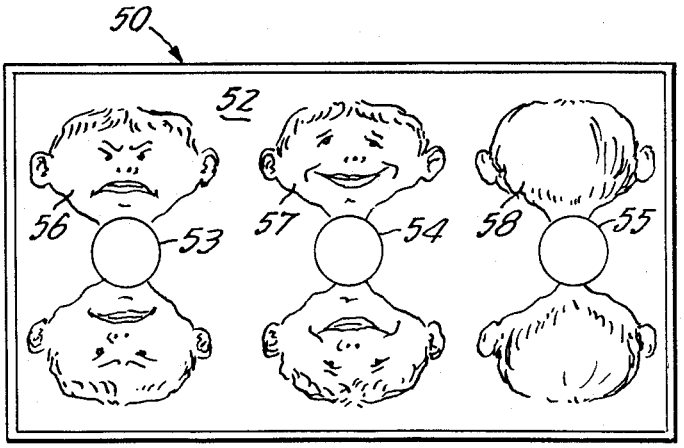
FIG. 4 is a top plan view of an alternate of second element.

In the alternate form of the second element illustrated in FIG. 4, and indicated by reference character 50, this element differs from element 12 in the provision of multiple locations for placing the beverage cup. Thus, the upper surface 52 includes plural circles 53, 54 and 55 and associated images 56, 57 and 58. By providing multiple images, the attention span of the child can be sustained for longer periods.

It may thus be seen that I have invented novel and highly useful improvements in anamorphic amusement devices, in which the cost of manufacture may be such as to permit discarding the device after a single use. Should the child desire to take the device home, it may be disassembled after use, and given to him for that purpose. There is also the added educational benefit of a subliminal introduction to optical physics for the child.

I wish it to be understood that I do not consider the invention to be limited to the precise details of structure shown and set forth in this specification, for obvious modifications will occur to those skilled in the art to which the invention pertains.

I claim:

1. An anamorphic amusement device for use with a frustoconically-shaped vessel comprising: a first reflective element formed of flexible planar material and having a reflective outer surface, said element being bounded by first and second concentric edges, and first and second end edges; means adjacent said end edges for interconnecting said end edges to form a hollow frustoconical shape; and a second element formed of planar material and having at least one printed surface, said printed surface having at least one anamorphic image thereon and at least one indexed location for determining the placement of said first element relative to said printed surface of said second element; whereby upon the occurrence of said placement, said anamorphic image may be viewed upon said reflective surface in undistorted form.

2. A device in accordance with claim 1, further characterized in said printed surface having plural indexed locations and corresponding plural anamorphic images associated therewith, said first element being selectively positionable upon any of said indexed locations.

3. In combination, a frustoconical vessel having upper and lower circular edges defining an outer surface; a first reflective element formed of flexible planar material and having a reflective outer surface, said element being bounded by upper and lower concentric edges, and first and second end edges; means adjacent said first and second end edges for interconnecting said end edges to form a hollow frustoconical shape, said first reflector element overlying said outer surface of said vessel and a second element formed of planar material and having at least one printed surface, said printed surface having at least one anamorphic image thereon and at least one indexed location for determining the placement of said cup relative to said printed surface of said second element; whereby upon the occurrence of said placement, said anamorphic image may be viewed upon said reflective surface of said first element in undistorted form.

4. The combination set forth in claim 3, further characterized in said printed surface having plural indexed locations, said cup being selectively positionable upon any of said locations.

* * * * *